United States Patent [19]

McMahan

[11] Patent Number: 4,466,537

[45] Date of Patent: Aug. 21, 1984

[54] CONCEALABLE HOLSTER

[76] Inventor: Lawrence E. McMahan, 2129 Lewis Dr., Lakewood, Ohio 44107

[21] Appl. No.: 431,314

[22] Filed: Sep. 30, 1982

[51] Int. Cl.[3] ..... B65D 85/00

[52] U.S. Cl. ..... 206/317; 150/52 R; 206/3; 42/1 R; 42/1 J

[58] Field of Search ..... 206/3, 315 R, 317; 150/0.5, 52 R, 52 H; 42/1 R, 1 J

[56] References Cited

U.S. PATENT DOCUMENTS

| | | | |
|---|---|---|---|
| 2,604,919 | 7/1952 | Harwood | 150/52 R |
| 2,781,897 | 2/1957 | Dale | 206/317 |
| 2,805,507 | 9/1957 | Buquor | 206/317 |
| 2,973,091 | 2/1961 | Berry | 206/486 |
| 3,329,278 | 7/1967 | Pachmayr | 206/315 |
| 3,720,013 | 3/1973 | McDonald | 42/1 J |
| 3,865,166 | 2/1975 | Pedro | 150/52 R |
| 4,377,249 | 3/1983 | Bockoven | 42/1 J |

FOREIGN PATENT DOCUMENTS

| | | | |
|---|---|---|---|
| 719892 | 2/1966 | Italy | 206/317 |

*Primary Examiner*—Joseph Man-Fu Moy

*Attorney, Agent, or Firm*—Pearne, Gordon, Sessions, McCoy, Granger & Tilberry

[57] ABSTRACT

A firearm holster, having the outward appearance of a billfold or wallet of the bifold-type, substantially conceals and disguises a pistol that can be fired from within the holster via a trigger finger receiving aperture in at least one side thereof. The holster includes a support block with restraining straps for maintaining the pistol at a proper firing position within the holster. Snap-type fasteners secure portions of the holster to each other to preclude its inadvertent opening. The holstered pistol can be carried in an inconspicuous manner for ready use in a clothes pocket of undercover police personnel or the like.

6 Claims, 7 Drawing Figures

CONCEALABLE HOLSTER

BACKGROUND OF THE INVENTION

The subject matter of this invention is related to my copending design patent application Ser. No. 343,718, filed Jan. 28, 1982.

The present invention relates in general to firearm holsters for handguns, and more particularly to a holster for concealing and disguising a pistol that can be fired from within the holster when held at a firing position.

Undercover police personnel and the like often carry pistols of the automatic or revolver-type. It is desirable to conceal and disguise the presence of a pistol on such personnel by use of a holster or holsterlike device having the appearance of an article not normally associated with firearms.

U.S. Pat. No. 3,720,013 discloses a pistol concealing baglike holster having the outward appearance of a purse or tobacco pouch. The pistol contained therein can be fired from within the pouch via a trigger finger receiving aperture in one of its sides. In firing the pouch-contained pistol, the high velocity bullet or slug tears out one end of the pouch. Also, the pouch-contained pistol is free to move about in the pouch, there being no means to retain the pistol at a proper firing position within the pouch.

SUMMARY OF THE INVENTION

In accordance with the present invention, a holster having the outward appearance of a billfold or wallet is adapted to carry and conceal a pistol. The holster includes a flexible cover member foldable to provide adjacent cover member portions between which the pistol can be positioned for firing from within the folded cover member, the cover members portions substantially covering and concealing at least the sides of the pistol. A retaining means fastened to the cover member engages the pistol to maintain its firing position between the cover member portions. A trigger finger receiving aperture is provided in at least one of the cover member portions to permit firing of the pistol from within the folded cover member.

In a preferred form, the holster of the present invention is comprised of a flat, rectangular piece of leather folded along a centerline to provide two adjacent cover halves between which the pistol is positioned. A generally rigid support block fastened to one of the cover halves has associated retaining straps that snap over portions of the pistol to hold it in place on the support block against recoil forces generated during firing of the pistol. A trigger finger receiving aperture is cut into at least one of the leather cover halves to permit firing of the pistol while mounted in the holster. Snap fasteners hold the cover halves together in adjacent relationship to preclude inadvertent opening of the walletlike holster.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
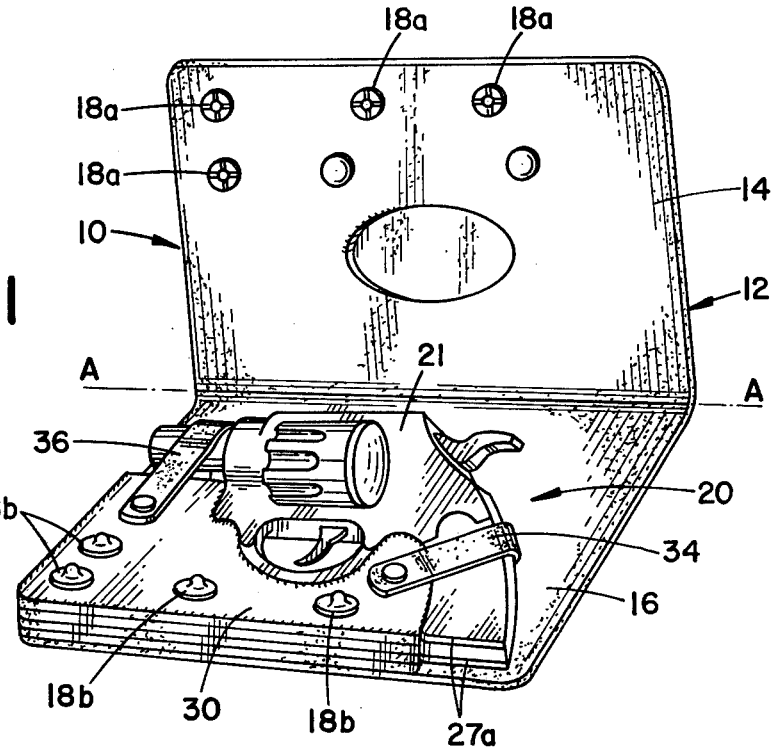
FIG. 1 is a perspective view of a holster in accordance with the present invention, the holster supporting a pistol of the revolver type, the holster being illustrated in a partially open condition.

FIG. 1 illustrates a firearm holster 10 in accordance with the present invention, the holster 10 preferably being made of leather or the like, and having a generally flat, flexible cover member 12. The cover member 12 includes a flap portion 14 and a base portion 16, such portions being formed by folding the flat, flexible cover member 12 along a fold line or centerline A—A to define two cover member sides or halves, i.e., the portions 14,16. A pistol 20, such as a short barrel 38 calibre revolver of the conventional type, having special grips to be subsequently discussed, is fixed in position on the base portion 16 of the cover 12.

The pistol 20 engages and is mounted on a support block 30 fastened to the base portion 16 by suitable means, e.g., by riveting. The support block 30 is generally rigid, and serves to engage in contiguous abutting fashion substantially all of the lower profile or lower peripheral edge of the pistol 20, as illustrated. The rigid support block 30 can be formed by several flat pieces of leather cut to identical shapes, the leather pieces being laminated by gluing to form the block, the block 30 having a thickness approximately equal to the thickness of a frame portion 21 of the pistol 20.

The pistol 20 is held in position on the support block 30 by a first support block attached retaining strap 34 and a second support block attached retaining strap 36, the straps 34, 36 functioning as a restraining means to hold the pistol in firing position on the block 30, especially against recoil forces generated by repeatedly discharging the pistol from within the holster.

The flap portion 14 of the cover member 12 can be folded over the pistol 20 and releasably secured to the support block 30 by conventional snap-type fasteners comprised of portions **18*a*,18*b*, as illustrated in FIG. 1**. Other type fastener means, such as Velcro strips or the like, could be utilized.

Figure 2:
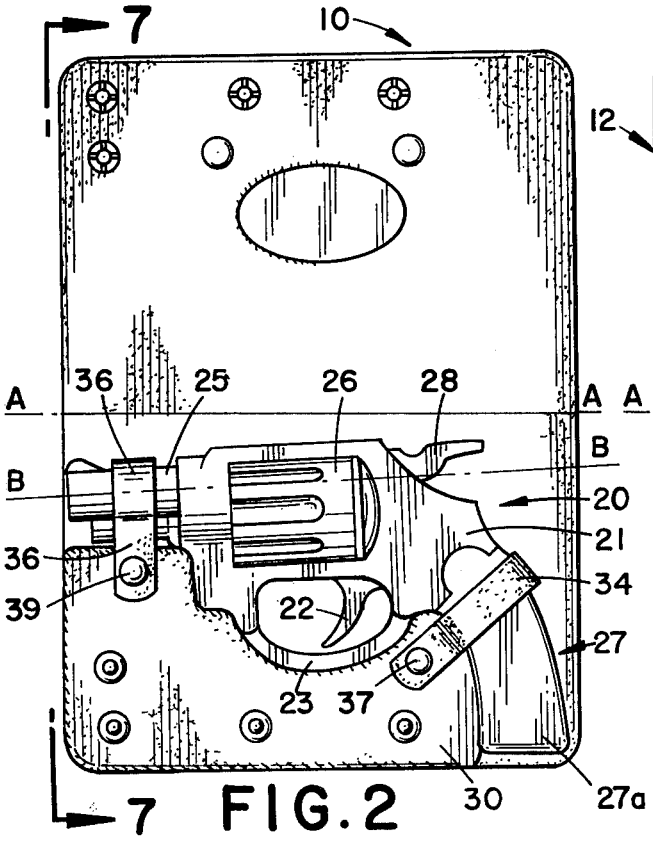
FIG. 2 is a plan view of the inside face of the holster of FIG. 1 in a fully open condition.
Figure 3:
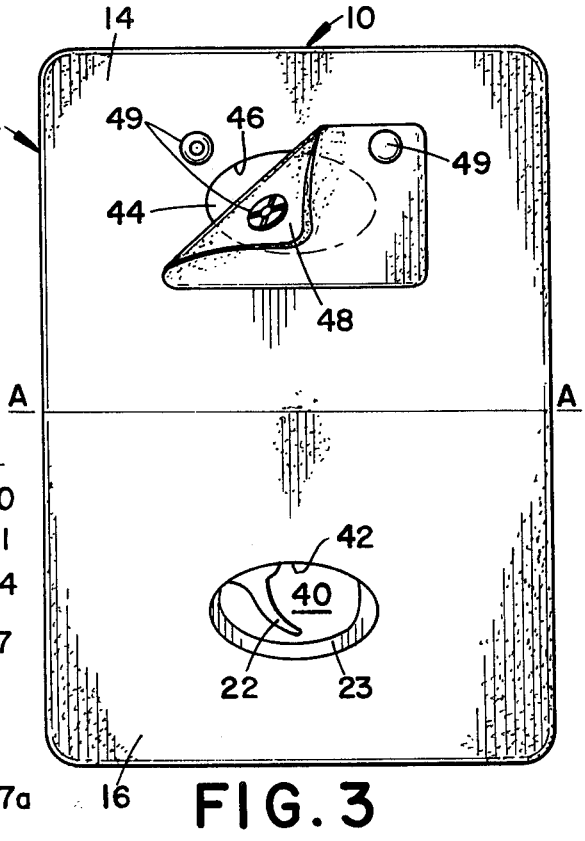
FIG. 3 is a plan view of the outside face of the holster of FIG. 1 in a fully open condition.

With reference to FIGS. 2 and 3, the pistol 20 includes the frame portion 21 having an associated grip portion 27, the frame portion 21 supporting a revolving cylinder 26 for receiving cartridges. The cartridges contained in the cylinder 26 are fired by means of a hammer 28 via a firing mechanism (not shown) actuated by a trigger 22 having an associated trigger guard 23. A barrel 25, which has its longitudinal axis B—B extending in non-parallel relation to the holster centerline A—A when the pistol 20 is mounted in the holster 10 as illustrated, extends from a front or muzzle end (leftward end as viewed in FIG. 2) of the holster to the cylinder 26. The purpose of the non-parallel relationship between the holster centerline A—A and the gun barrel axis B—B will be subsequently discussed.

It can be seen that the first retaining strap 34 engages and snaps over the upper end of the pistol grip portion 27, the first strap 34 having its one end fixed to the block 30 by suitable means, while its other end is releasably secured to the block member 30 by means of a first retaining strap snap 37 of similar construction of the holster snap portions 18*a*,18*b* illustrated and discussed with regard to FIG. 1. The second retaining strap 36 engages and snaps over the distal end or muzzle of the barrel 25 to hold it in position against the support block 30. Like the strap 34, strap 36 has one of its ends fastened to the support block 30, while its other end is fixed in position by a releasable second retaining strap snap 39.

It is noted that two opposed side grips 27*a* (see FIG. 1) carried on the outside faces of the grip portion 27 are preferably of special thin wall design. Such grips, for example, can be formed of thin, relatively rigid plastic. These thin-walled grips 27*a* provide the grip portion 27 with a width approximately equal to the thickness of the block 30, thus permitting the portions 14,16 of the cover member 12 to be folded over the piston without bulging of the cover member 12 at the grip portion area, as would occur with conventional thick-walled pistol grips.

With particular reference to FIG. 3, the base portion 16 of the cover member 12 can be seen to include a centrally located right-hand trigger finger receiving aperture 40 that is defined by a generally oval-shaped edge wall 42. The aperture 40 permits insertion of a trigger finger into engagement with the trigger 22 to allow firing of the pistol 20 from within the holster 10.

Provided in the flap portion 14 of cover member 12 is a centrally located left-hand trigger finger receiving aperture 44 that is defined by an edge wall 46 of oval shape. The apertures 40,44 are positioned generally identically relative to their respective cover portions 14,16 so as to be generally aligned in opposed relation to each other to either side of the trigger 22 when the cover member 12 is folded in bifold manner along the centerline A—A to substantially conceal the sides of the pistol 20.

It is noted that the firearm holster 10 illustrated in the drawings is a right-hand type, i.e., the holster is intended for use by a person who would normally fire the pistol 20 while gripping the folded holster with his or her right hand. Thus, the aperture 40 is always accessible to the gun user's right-hand index trigger finger. The left-hand trigger finger receiving aperture 44 is normally closed by a flap member 48 releasably held in position over the aperture 44 by a pair of snaps 49 similar to the snap portions 18*a*,18*b* as discussed earlier with regard to FIG. 1. In a situation where it would be necessary to fire the pistol 20 with the left hand, the flap 48 could be snapped open to permit access to the trigger 22 with the left-hand index trigger finger. A left-hand type holster would be provided by positioning the flap 48 over aperture 40 instead of aperture 44 as illustrated. It is noted that, while only one trigger finger aperture is required for firing of the pistol, the provision of two apertures permits firing from either the right or left hand, and also facilitates full and complete insertion of the trigger finger through the trigger guard 23.

Figure 5:
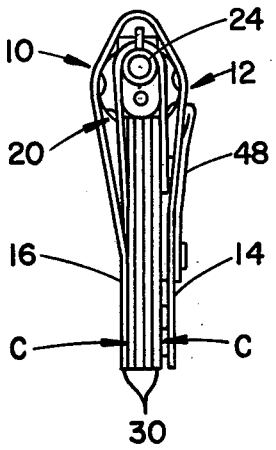
FIG. 5 is a muzzle end view of the holster of FIG. 1 in a fully closed firing condition.
Figure 4:
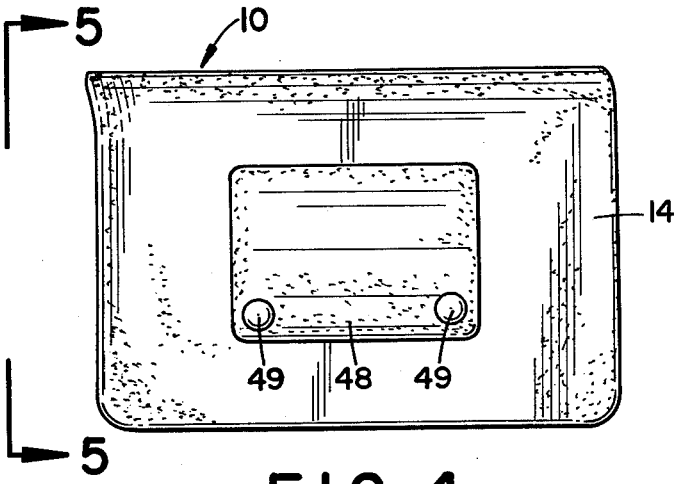
FIG. 4 is a left side elevation view of the holster of FIG. 1 in a fully closed firing condition.
Figure 6:
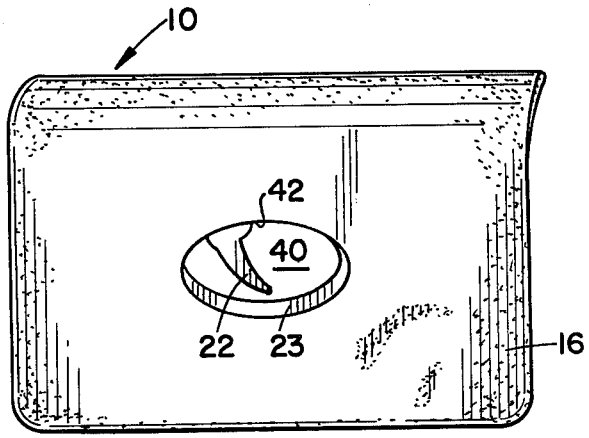
FIG. 6 is a right side elevation view of the holster of FIG. 1 in a fully closed firing condition.

With reference to FIGS. 4, 5, and 6, the holster 10 of the present invention is illustrated in a folded firing condition so as to present the outward appearance of a billfold or wallet of the bifold type, the holster 10 with the pistol 20 contained therein being adapted for carrying in a user's hip pocket, for example. As shown most clearly in FIG. 5, with the firearm holster 10 having its flexible cover member 12 in a folded and snapped closed condition, the flap portion 14 and the base portion 16 are in adjacent relationship to each other, and in effect sandwich between them the pistol 20. Due to the thickness (distance C—C) of the block 30, which generally matches the frame thickness of the pistol, and due to the relative thinness of the grip portion 27 and because of the special thin wall grips 27*a* (see FIG. 2), the side portions 14,16 when in a folded condition are generally parallel to each other but for a slight bulge in the cylinder area of the pistol. Thus, one viewing the holster 10 would not be led by its appearance to suspect that a pistol 20 was contained therein. Further, the relatively thick block 30 solidly supports the pistol 20 for firing.

It can also be seen, especially from FIGS. 4 and 6, that the ends of the pistol do not extend beyond the edges (left and right end of FIGS. 4 and 6) of the flap and cover portions 14,16 wherein the pistol is in effect disguised as a wallet or billfold. Further, with reference to FIG. 5, it can be seen that the muzzle end 24 of the barrel of the pistol 20 is not interfered with by any portions of the holster 10 so as to allow unobstructed firing of the pistol 20 from within the holster. In other words, the barrel associated end of the folded cover member is open to permit free egress, from within the holster, of a bullet fired by the pistol positioned within the cover member.

Figure 7:
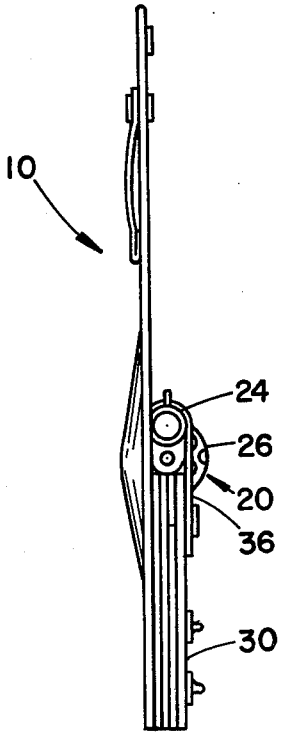
FIG. 7 is a muzzle end view of the holster of FIG. 1 at a fully open condition.

With reference to FIG. 7, it is noted that the cylinder 26 of the pistol 20 can easily revolve during consecutive firings of the pistol, since the side portions 14,16 of the holster are properly dimensioned so that they do not apply excessive friction to the rotatable cylinder. Also, the foldline A—A (see FIGS. 1 through 3) is spaced above the pistol 20 by an appropriate distance to permit free movement of the hammer 28.

In use, the firearm holster of the present invention, when carried in the hip pocket of the user, will appear as a wallet or billfold. During an attempted robbery or mugging, for example, the gun user will appear to be surrendering his or her billfold, but will in fact be drawing the holstered pistol to a firing position wherein it can be repeatedly discharged from within the folded holster. The open muzzle end (and to a lesser extent the open grip end, which could be closed) of the holster 10 allows high pressure combustion gases to readily escape from between the side portions 14,16 of the holster 10 during firing of the pistol. During such firing, recoil forces generated by the pistol do not cause mispositioning of the pistol within the holster 10, due to the restraining effect of straps 34,36, and due to the rigid nature of the support block 30, the block 30 with the overlapped folded base and flap cover portions 14 and 16 being easily gripped by the user. As noted earlier with reference to FIG. 3, the barrel axis B—B diverges downwardly away from the wallet centerline A—A, due to the predetermined positioning of the pistol by means of the support block 30 mounted on the base portion 16 of the cover 12. Thus, the holstered pistol 10 can be accurately aimed along centerline A—A, the slight downward angle of the barrel axis B—B compensating for recoil forces that will move the barrel upwardly to place the bullet on the sight line along A—A.

The holster as illustrated in FIGS. 1 through 7 of the present invention has been successfully used by undercover police personnel, who consider it very durable, reliable, and comfortable to carry and use. While FIGS. 1 through 7 illustrate the holster as being adapted to carry a revolver-type pistol, it is noted that other types of handguns, such as automatic pistols, could be accommodated by proper dimensioning of the holster elements. It is also noted that, while the holster 10 is preferably formed of relatively thick leather that will withstand the recoil forces and cartridge combustion gas pressure blasts generated by repeated firing of the holstered pistol, other materials of suitable strength could be utilized.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A firearm holster having the outward appearance of a billfold or wallet of the bifold-type, the holster being adapted to carry and conceal a pistol having a grip portion, a frame portion, a rotatable cartridge receiving cylinder, a trigger, a hammer, and an elongated barrel, the holster comprising:

a generally flat, flexible cover member foldable along a centerline to provide adjacent cover member halves between which the pistol can be positioned for firing from within the folded cover member, the barrel associated end of the folded cover member being open to permit free egress, from within the holster, of a bullet fired by the pistol positioned within the cover member, said halves substantially covering and concealing at least the sides of the pistol;

a generally rigid support block fastened to at least one of said halves, the support block engaging portions of the pistol to maintain its firing position between said halves against recoil forces generated by the firing of the piston;

at least one retaining strap for holding the pistol in position on the support block; and a trigger finger receiving aperture provided in at least one of said halves to permit firing of the pistol from within the folded cover member.

2. A firearm holster according to claim 1, including first and second retaining straps for holding the pistol in engagement with the block, the retaining straps being anchored to the holster and applying a restraining force to the pistol to hold it against the block during firing.

3. A firearm holster according to claim 1, wherein a portion of the block in engagement with the pistol is profiled to substantially engage in contiguous relation a major portion of the lower periphery of the pistol, the thickness of the block being generally equal to the thickness of the frame portion of the pistol.

4. A firearm holster according to claim 1, including another trigger finger receiving aperture provided in the other of said halves to permit firing of the pistol from within the folded cover member, said apertures being adjacent to each other in opposed relation to either side of the pistol trigger.

5. A firearm holster according to claim 4, including a flap member adapted to cover one of said apertures, a portion of said flap member being releasably fastened to at least one of said cover member halves to maintain the flap member in position over the associated aperture.

6. A firearm holster according to claim 1, wherein the longitudinal axis of the barrel portion is in non-parallel relation to the said centerline.

* * * * *